US007211102B2

(12) United States Patent
DeSousa et al.

(10) Patent No.: US 7,211,102 B2
(45) Date of Patent: May 1, 2007

(54) PRESSURE-ACTIVATED VIBRATING TEETHER

(75) Inventors: Vasco DeSousa, Pawtucket, RI (US); Joseph F. Brewin, Franklin, MA (US); James J. Britto, Westport, MA (US); Lawrence J. Salvo, Stow, MA (US); Marsha Merianos, East Bridgewater, MA (US)

(73) Assignee: The First Years Inc., Avon, MA (US)

( * ) Notice: Subject to any disclaimer, the term of this patent is extended or adjusted under 35 U.S.C. 154(b) by 258 days.

(21) Appl. No.: 10/428,530

(22) Filed: May 1, 2003

(65) Prior Publication Data

US 2004/0093033 A1 May 13, 2004

(51) Int. Cl.
*A61J 17/00* (2006.01)

(52) U.S. Cl. ..... 606/235

(58) Field of Classification Search ..... 606/234, 606/235, 236

See application file for complete search history.

(56) References Cited

U.S. PATENT DOCUMENTS

| | | | | |
|---|---|---|---|---|
| 3,115,139 | A | 12/1963 | Schneider | |
| 3,990,455 | A * | 11/1976 | Panicci | 606/235 |
| 4,116,202 | A * | 9/1978 | Panicci | 606/235 |
| D264,880 | S | 6/1982 | Panicci | |
| 4,554,919 | A * | 11/1985 | Hubert | 606/234 |
| 5,197,974 | A * | 3/1993 | Scarpelli et al. | 606/235 |
| 5,540,720 | A * | 7/1996 | Ortega | 606/235 |
| 5,551,952 | A * | 9/1996 | Falgout | 601/139 |
| D381,751 | S | 7/1997 | Lun | |
| 5,649,964 | A * | 7/1997 | Berman et al. | 606/235 |
| 5,683,421 | A | 11/1997 | Guarini, Jr. et al. | |
| D391,363 | S | 2/1998 | Rohrig | |
| 5,772,684 | A * | 6/1998 | Shrock | 606/236 |
| 5,782,868 | A | 7/1998 | Moore, Jr. et al. | |
| 5,842,901 | A * | 12/1998 | Montgomery | 446/77 |
| 5,902,322 | A * | 5/1999 | Scagliotti | 606/235 |
| D411,303 | S | 6/1999 | Scagliotti | |
| 6,056,774 | A * | 5/2000 | Johansen et al. | 606/234 |
| 6,183,427 | B1 | 2/2001 | Ishii | |
| 6,228,105 | B1 * | 5/2001 | Johansen et al. | 606/234 |
| 6,241,110 | B1 * | 6/2001 | Hakim | 215/11.1 |
| 6,264,678 | B1 | 7/2001 | Landers | |
| 6,447,536 | B1 * | 9/2002 | Hinshaw | 606/235 |
| 6,468,294 | B2 | 10/2002 | Griffith | |
| 6,643,884 | B1 * | 11/2003 | Everett | 15/110 |
| 6,814,247 | B2 * | 11/2004 | Matthias | 215/11.1 |
| 2005/0119699 | A1 * | 6/2005 | Sari | 606/234 |

FOREIGN PATENT DOCUMENTS

| | | |
|---|---|---|
| EP | 0 185 614 A1 | 6/1986 |

* cited by examiner

*Primary Examiner*—Michael J. Hayes
*Assistant Examiner*—M. Thomas Andersen
(74) *Attorney, Agent, or Firm*—Michael Best & Friedrich LLP

(57) ABSTRACT

A teething device is provided which includes a fluid-filled membrane sized to be at least partially received in the mouth of a child, a housing attached to the fluid-filled membrane, a handle sized to be grasped by a child, a vibrator configured to impart vibration to the fluid-filled membrane and a pressure switch selectively connecting the vibrator to a power source when a threshold pressure is applied to an outer surface of the membrane.

18 Claims, 6 Drawing Sheets

PRESSURE-ACTIVATED VIBRATING TEETHER

TECHNICAL FIELD

The invention provides a teether for massaging the gums of a teething child and includes a fluid-filled membrane having a resilient biting surface. Vibration is imparted to the teether through the membrane to provide further stimulation to the gums of the child. This damped mechanical vibration provided through the membrane and to the biting surface along the outer surface of the membrane stimulates and massages the gums of the child.

BACKGROUND

Teething is the sequential appearance of baby teeth. Generally speaking, teething begins around age six months, and continues until the baby is about three years old. But in some healthy babies, the first tooth appears in the third month; in others, it doesn't emerge until the infant is a full year old. As a child begins teething, providing a soft article to chew on may provide some relief from discomfort, hasten the eruption of the teeth from the gumline and provide a distraction from the general discomfort associated with the teething process.

SUMMARY

The invention provides a teether for massaging the gums of a teething child and includes a fluid-filled membrane having a resilient biting surface. Vibration is imparted to the teether through the membrane to provide further stimulation to the gums of the child. This damped mechanical vibration provided through the membrane and to the biting surface along the outer surface of the membrane stimulates and massages the gums of the child.

In general, in one aspect the invention provides a teething device which includes a fluid-filled membrane that is sized to at least partially fit in the mouth of a child. A housing is attached to the fluid-filled membrane and includes a handle sized to be grasped by a child. Within the housing, a vibrator is configured to impart vibration to the fluid-filled membrane and a pressure switch selectively connects the vibrator to a power source. The fluid-filled membrane can contain a pliable gel, sterilized water or other suitable fluid medium.

Implementation of this aspect of the invention may include one or more of the following features in various embodiments. The vibrator can include an eccentric weight rotably attached to the motor and disposed within the housing. The pressure switch can be coupled to the fluid-filled membrane and configured to activate the motor when a threshold pressure is applied to an outer surface of the fluid-filled membrane.

In one embodiment, the pressure switch includes two substantially parallel strips attached together at a first end and disposed in close proximity to each other at a second end, such that when the threshold pressure is applied to the outer surface of the fluid-filled membrane, the parallel strips at the second end contact each other and activate the motor. In another embodiment, the membrane further includes a protrusion near the second ends of the switch which preferentially deflects outward to contact second ends of the switch when the threshold pressure is applied to the membrane. The pressure switch can be adapted to respond to gum pressure on the outer surface of the membrane. The switch may also be adapted to respond to fluid pressure within the membrane.

In one embodiment, the motor cycles for a predetermined duration when activated by the pressure switch. In another embodiment, the teething device includes a programmed circuit connected to the pressure switch for producing a sound to complement the vibratory movement when the threshold pressure is applied. In a further embodiment, the outer surface of the membrane device includes teething tabs. In other embodiments, the teether includes a rattle.

In another aspect, the invention provides a method of messaging the gums of a child including the steps of placing the fluid-filled membrane of a teether described in the first aspect of the invention close to a child's mouth, placing the handle proximate to a child's hand, and imparting vibratory motion to the membrane when the threshold pressure is applied to the outer surface of the membrane.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements. Other features and advantages of the invention will be apparent from the description of preferred embodiments thereof, taken together with the drawings, and from the claims.

DETAILED DESCRIPTION

Figure 1:
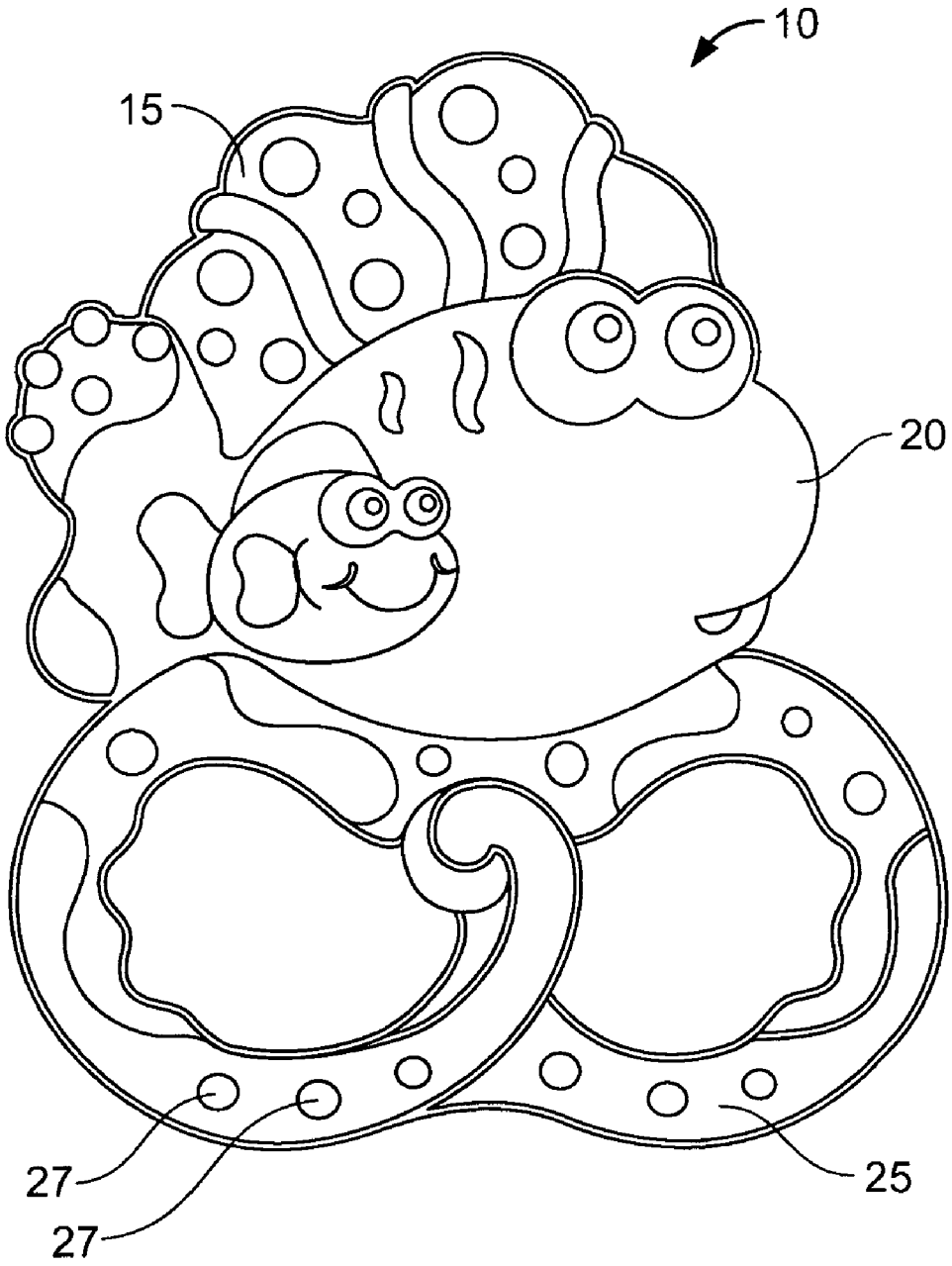
FIG. 1 is a perspective view of an assembled teether, according to the invention.

As shown in FIG. 1, a vibrating teether 10 includes a fluid-filled membrane 15, a housing 20 and a handle 25. The membrane 15 is dimensioned to fit at least partially within the mouth of a child while the handle 25 is dimensioned and configured to fit the hand of a child. The housing 20 may include, for example, a rattle. The handle 25 may further include looped structures to allow relatively unrestricted movement of the infant's fingers while grasping the teether 10. The membrane 15 provides a teething surface and may include a plurality of protuberances 27 arranged about the outer surface to further stimulate the gums of the teething child.

Figure 2:
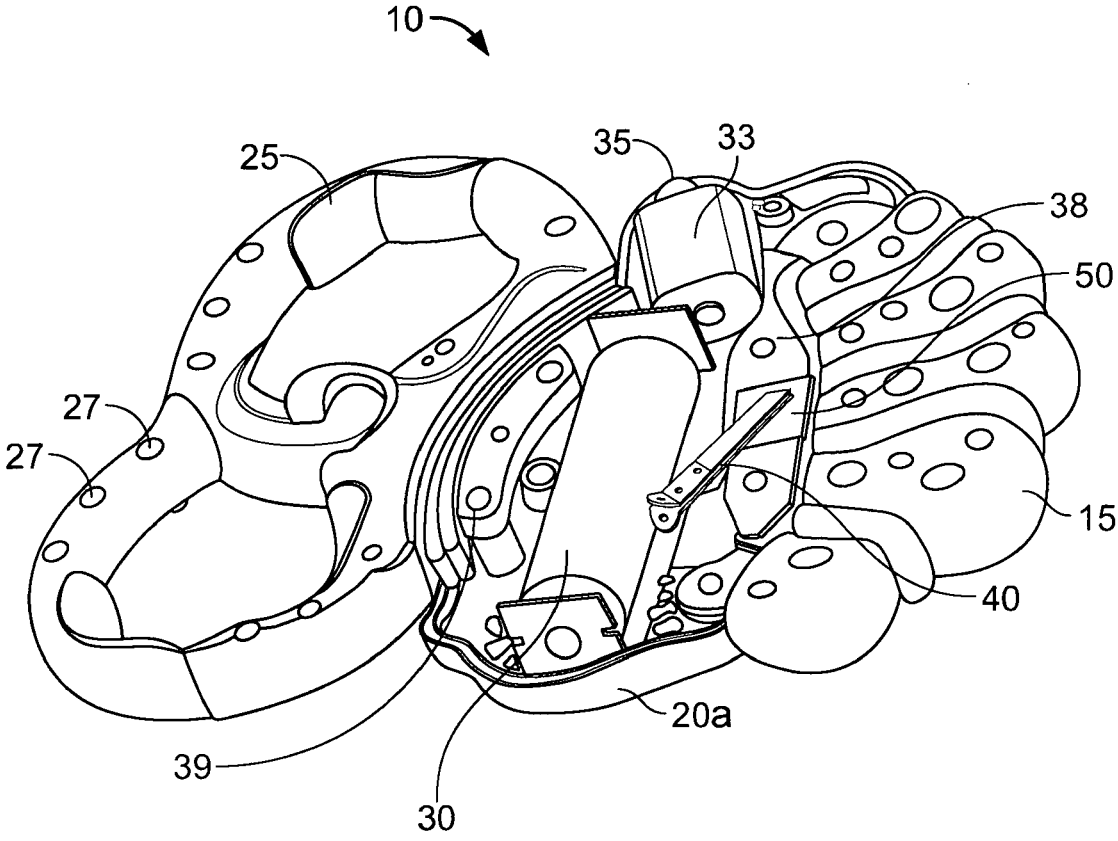
FIG. 2 is a perspective view of the teether shown in FIG. 1 with one section of the housing removed to show component detail.
Figure 3:
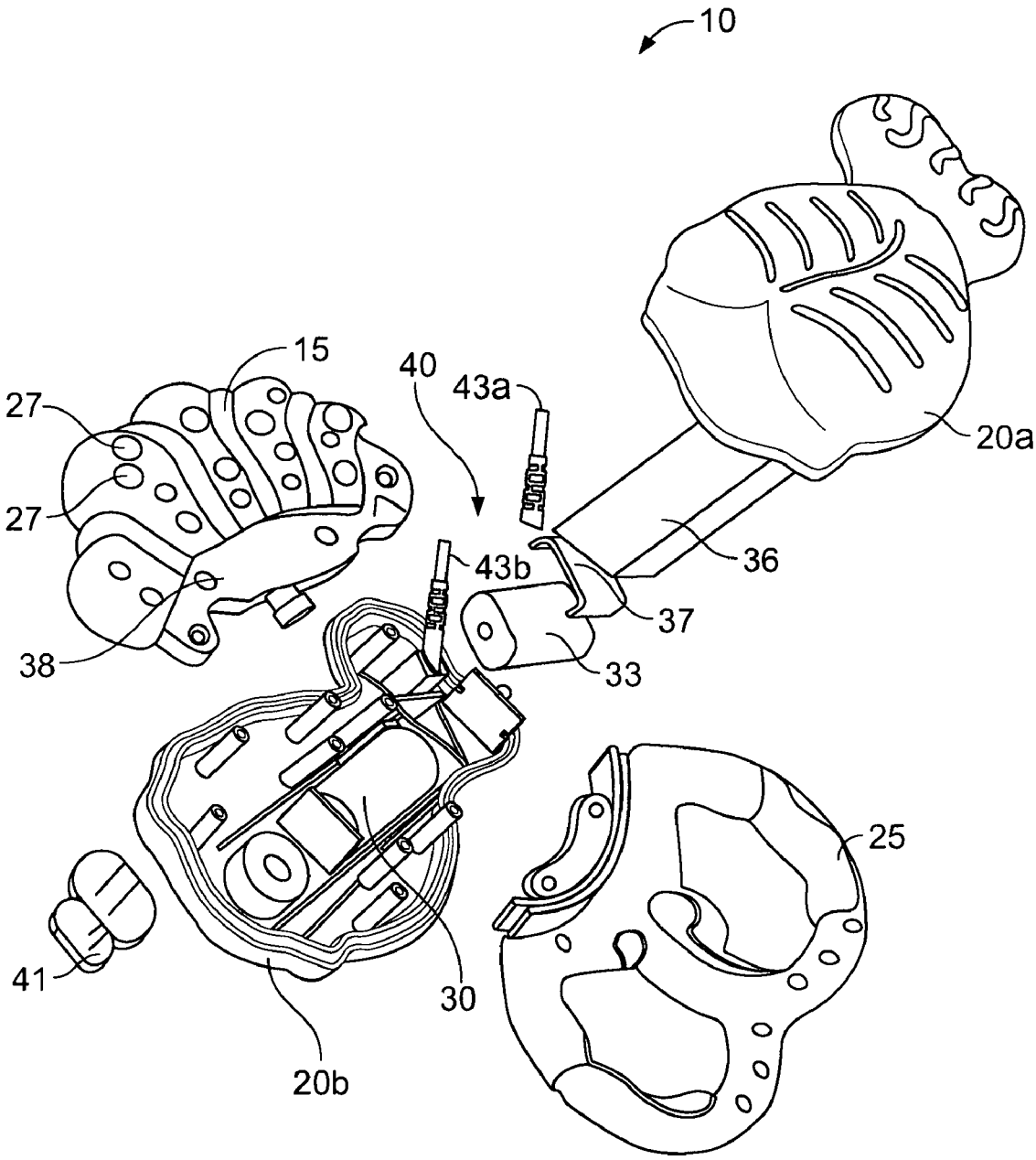
FIG. 3 is an exploded perspective view of the teether shown in FIG 1.

As shown in FIGS. 2 and 3, and in one embodiment, the housing 20 comprises two halves 20*a*, 20*b* joined (only housing half 20*a* is shown in FIG. 2 and only half 20*b* is shown in FIG. 3) together to store a power source 30, a motor 33 and a vibrator 35 disposed within the cavity formed between the housing halves 20*a*, 20*b*. The motor 33 is rotably connected to the vibrator 35. The vibrator 35 may include, for example, an eccentric weight and a rotor attached to the motor 33 which rotates the weight. Rotation of the shaft by motor 33 causes an oscillation of the weight and vibratory movement of the teether 10. A power source cover 36 (FIG. 3) secures the power source 30 to the housing 20 and a bracket 37 secures the motor 33 along with the vibrator 35 to the housing 20. A protrusion 38 on the membrane 15 and a protrusion 39 on the handle 25 are each engaged between the housing halves 20*a*, 20*b* to affixed each firmly to the edges of the housing 20. The power source 30 and the motor 33 are selectively connected by a pressure switch 40.

In one embodiment, the housing 20 and handle 25 may be decoratively shaped and configured for aesthetic purposes. For example, the teether 10 can include one or more decorative elements 41 (FIG. 3) secured to an outside surface of the housing 20.

Figure 4A:
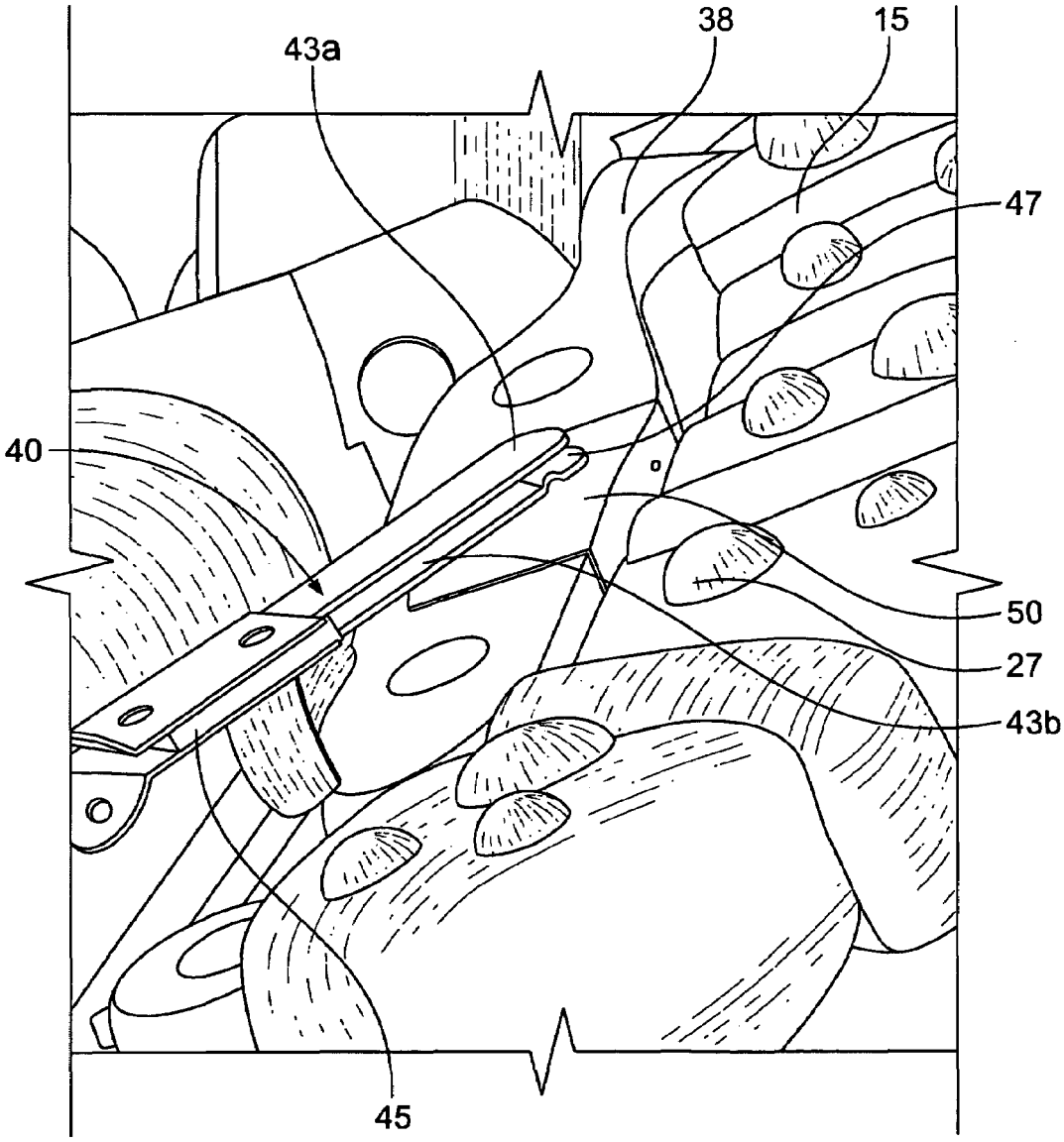
FIGS. 4A to 4C are detailed views of the pressure switch and surrounding components in the embodiment of FIG. 1.
Figure 4B:
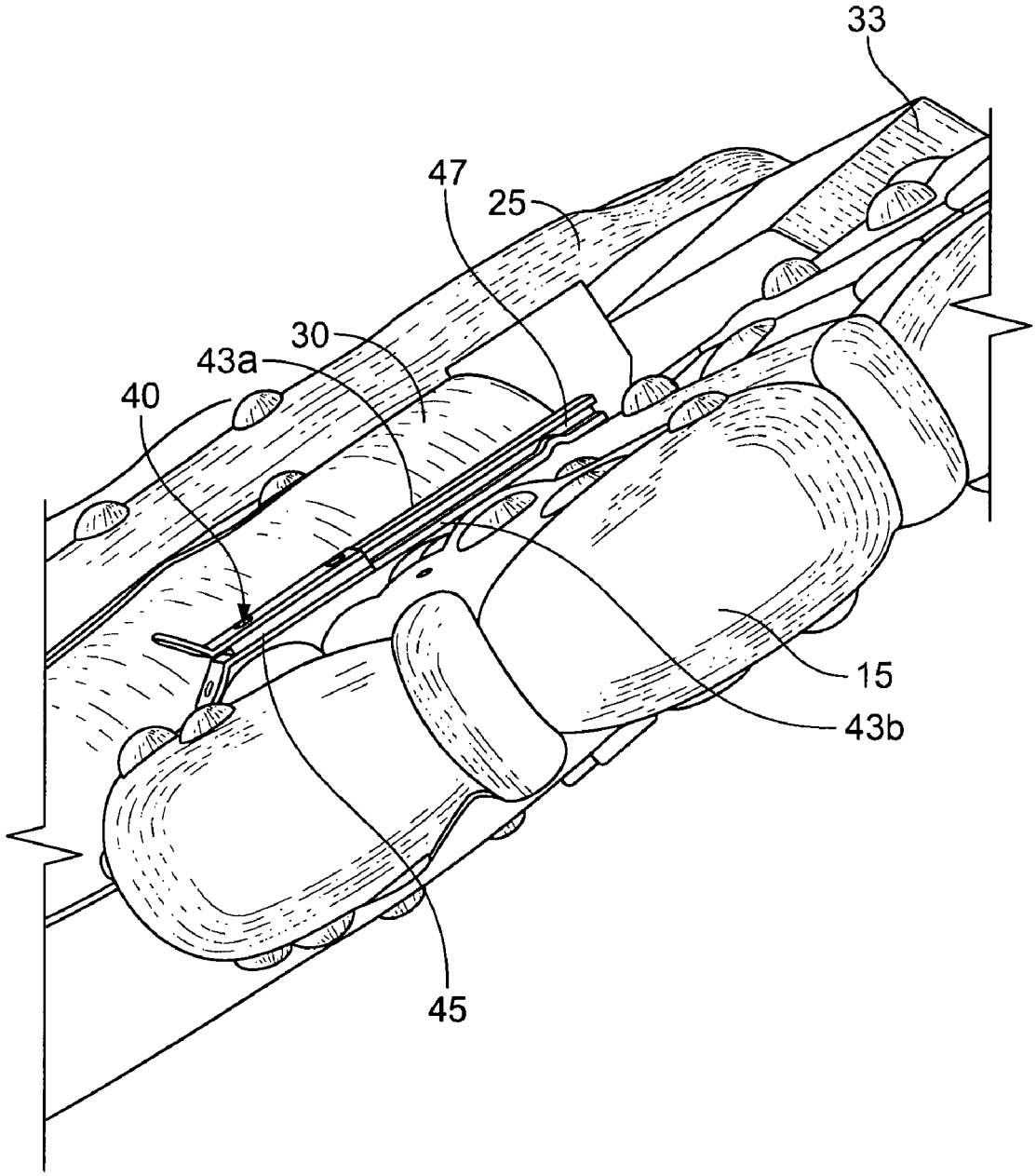
Figure 4C:
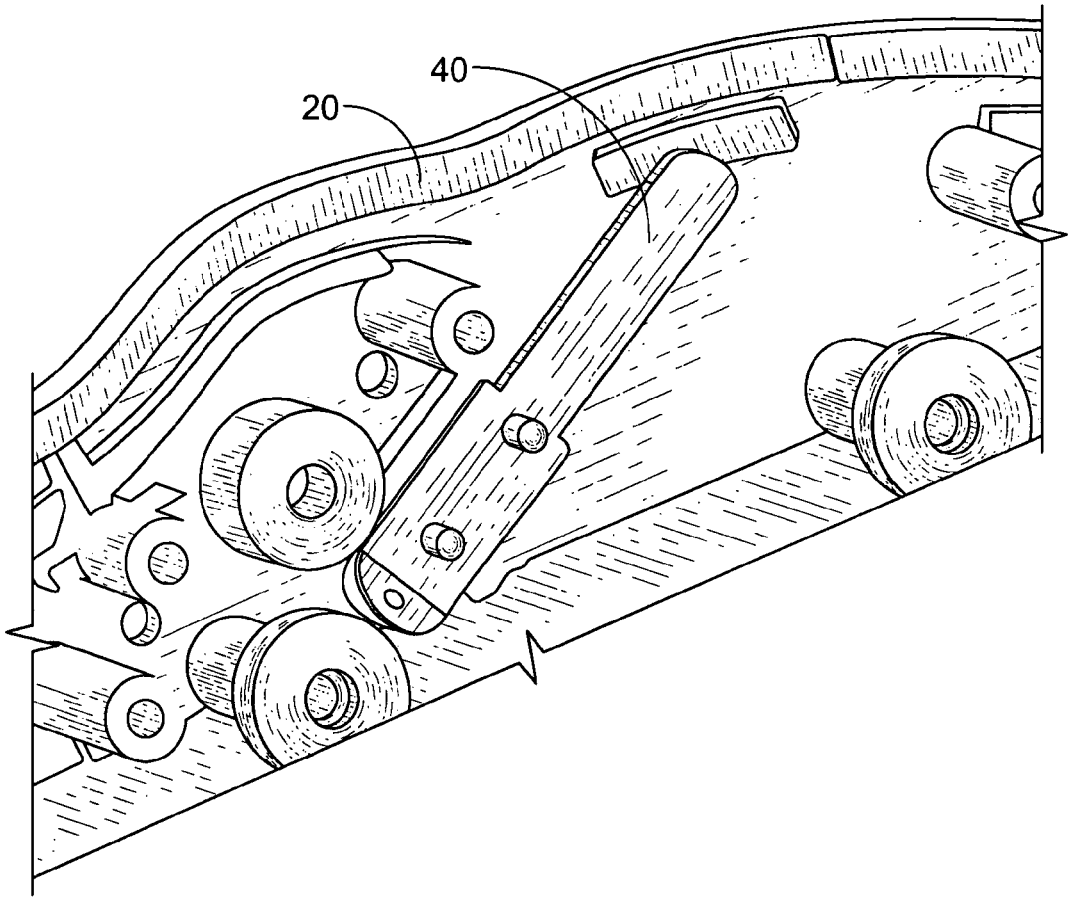

As shown in FIGS. 4A to 4C, and in one embodiment, the pressure switch 40 comprises two substantially flexible and generally parallel strips 43*a*, 43*b* made from an electrically conductive material and separated from each other at a first end by a spacer 45 and located proximate each other and separated by a control gap 47 at a second end. The pressure switch 40 is positioned within the housing 20 and adjacent the membrane 15 such that the gap 47 at the second end of the of the pressure switch 40 is proximate to a protrusion 50 extending from an outer surface of the membrane 15. In other embodiments, the second end of the pressure switch 40 is coupled to the membrane 15.

In one embodiment, the handle 25 is formed of injection molded polypropylene and thermoplastic elastomer (TPE) overmold. The wall of the membrane 15 is preferably between about 0.08 and 0.10 inches and may be formed by any resilient material suitable for teething devices which may include, for example, a TPE. The membrane 15 may contain sterilized water, a pliable gel or other suitable fluid medium, such that it is easily deformable to gum pressure applied to the outer surface of the membrane 15.

In operation, when a threshold pressure is exerted on an outer surface of the membrane 15, the fluid pressure within the membrane increases sufficiently to deflect the protrusion 50 outward to close the control gap 47 at the second end of the pressure switch 40. In one embodiment, the threshold pressure is between about 1 and 6 pounds and more preferably between about 2 and 4 pounds. The exertion of the threshold pressure on the membrane 15 closes the pressure switch 40 thereby activating the motor 33 and the vibrator 35. In one embodiment, the teether 10 includes a programmed circuit (not shown) to operate the motor 33 for a predetermined cycle time for each activation of the pressure switch 40. In a further embodiment the teether 10 contains a programmed sound circuit and speaker (not shown) disposed within the housing 20 selectively connected to the power source 30 by the pressure switch 40. Closing the pressure switch 40 activates the programmed sound circuit to produce a pleasing sound to amuse the teething child.

A number of embodiments of the invention have been described. Nevertheless, it will be understood that various modifications may be made without departing from the spirit and scope of the invention. For example, the housing 20 and handle 25 may be of single unitary construction. Accordingly, other embodiments are within the scope of the following claims.

What is claimed is:

1. A teething device comprising:

a fluid-filled membrane sized to be at least partially received in the mouth of a child;

a housing attached to the fluid-filled membrane and comprising a handle sized to be grasped by a child;

a vibrator configured to impart vibration to the fluid-filled membrane; and a pressure switch, responsive to a hydraulic pressure developed within the fluid filled membrane, coupled to the fluid-filled membrane and selectively connecting the vibrator to a power source when the hydraulic pressure is developed in response to a threshold pressure applied to an outer surface of the fluid filled membrane.

2. The device of claim 1 further comprising a motor disposed within the housing and rotatably attached to the vibrator.

3. The device of claim 1 wherein the pressure switch is affixed to the fluid filled membrane, the pressure switch comprises two substantially parallel strips attached together at a first end and disposed proximally at a second end such that when the threshold-pressure is applied to the outer surface of the fluid-filled membrane, the second ends contact each other and activate the motor.

4. The device of claim 3 wherein the membrane further comprises a protrusion proximate to the second end of the switch, the protrusion deflecting outward and contacting the second end of the switch when the threshold pressure is applied.

5. The teething device of claim 1 wherein the vibrator comprises an eccentric weight and rotor that rotates the weight.

6. The teething device of claim 1 wherein a wall thickness of the membrane is between about 0.08 and 0.10 inches.

7. The teething device of claim 1 wherein the switch is responsive to gum pressure on the outer surface of the membrane.

8. The-teething device of claim 1 wherein the switch is responsive to fluid pressure within the membrane.

9. The teething device of claim 2 wherein the motor cycles for a predetermined duration when activated by the pressure switch.

10. The teething device of claim 1 wherein the membrane contains a pliable gel.

11. The teething device of claim 1 wherein the membrane contains sterilized water.

12. The teething device of claim 1 wherein the housing further comprises a rattle.

13. The teething device of claim 1 wherein the membrane comprises teething tabs.

14. The teething device of claim 1 wherein the threshold pressure is between 1 and 6 pounds.

15. The teething device of claim 1 wherein the membrane comprises a thermoplastic elastomer.

16. The teething device of claim 1 wherein the handle is formed of injection molded polypropylene.

17. A teething device comprising:

a fluid-filled membrane sized to be at least partially received in the mouth of a child;

a housing attached to the fluid-filled membrane and further comprising a handle sized to be grasped by a child;

a vibrator operably linked to the fluid-filled membrane;

a motor and power source disposed within the housing and rotatably attached to the vibrator; and a pressure switch, responsive to a hydraulic pressure developed within the fluid-filled membrane, coupled to the fluid-filled molded membrane, the pressure switch selectively connecting the motor and the power source when the hydraulic pressure is developed in response to a threshold pressure applied to an outer surface of the fluid filled membrane.

18. A method of massaging the gums of a child, the method comprising: placing a fluid-filled membrane of a teether proximate to a child's mouth and placing a handle of the teether proximate to a child's hand, the teether including a vibrator and a power source; activating a pressure switch when a hydraulic pressure is developed within the fluid-filled membrane in response to a predetermined threshold pressure applied to an outer surface of the membrane; selectively connecting the vibrator and the power source in response to activation of the pressure switch; and imparting vibratory motion to the membrane.

* * * * *